United States Patent [19]

Maeyama et al.

[11] Patent Number: 4,907,542

[45] Date of Patent: Mar. 13, 1990

[54] CLEANING SYSTEM FOR A HORIZONTAL TYPE TUBE ASSEMBLY

[75] Inventors: Takuzo Maeyama; Kenichi Nii; Shigeru Shimojo, all of Osaka; Keiichi Iwamoto; Masaaki Torichigai, both of Nagasaki, all of Japan

[73] Assignees: The Kansai Electric Power Co., Inc., Osaka; Mitsubishi Jukogyo Kabushiki Kaisha, Tokyo, both of Japan

[21] Appl. No.: 326,043

[22] Filed: Mar. 17, 1989

[30] Foreign Application Priority Data

Mar. 17, 1988 [JP] Japan ..... 63-61947
Mar. 17, 1988 [JP] Japan ..... 63-61948

[51] Int. Cl.[4] ..... F22B 37/18; F22B 37/48

[52] U.S. Cl. ..... 122/379; 122/391; 122/392; 165/84; 165/95

[58] Field of Search ..... 122/379, 381, 390, 391, 122/392, 382; 165/95, 84; 15/317

[56] References Cited

U.S. PATENT DOCUMENTS 3,736,909 6/1973 Marangohi et al. ..... 122/390
4,474,143 10/1984 Wincze ..... 122/379
4,474,497 10/1984 Sullivan ..... 122/379 X

FOREIGN PATENT DOCUMENTS 930959 7/1955 Fed. Rep. of Germany .
2087508 5/1982 United Kingdom .

OTHER PUBLICATIONS

Patent Abstracts of Japan, vol. 11, No. 50 (M-562) [2497], Feb. 17, 1987.
Patent Abstracts of Japan, vol. 10, No. 326 (M-532) [2382], Nov. 6, 1986.
Patent Abstracts of Japan, vol. 10, No. 59 (M-459) [2116], Mar. 8, 1986.

*Primary Examiner*—Edward G. Favors
*Attorney, Agent, or Firm*—Wenderoth, Lind & Ponack

[57] ABSTRACT

An improved cleaning system for a horizontal type tube assembly which can achieve cleaning of the outer surfaces of the tubes in the tube assembly automatically by remote control without necessitating human labor of workers who are compelled to work in a narrow limited space, is disclosed. The improvements reside in that the cleaning system comprises a cleaning main body section including a cleaning jig for an outer surface of a tube, a screw and a motor in combination for reciprocating the cleaning jig in the axial direction of the tube, another motor for diverting the direction of the cleaning jig, and a support plate for supporting the aforementioned members; an upper traversing section including a winding drum, lifting wires and a winding motor in combination for raising and lowering the cleaning main body section to any arbitrary height, a traveling roller for moving in the axial direction of the tube, and a drive motor for driving the traveling roller; the cleaning main body section further including a sensor for detecting the tube during rising and lowering of the cleaning main body section, and an urging plate which is mounted to the cleaning main body section via an expansible and contractible cylinder. Preferably, the cleaning jig is provided with air hammers for striking the outer surface of the tube.

2 Claims, 5 Drawing Sheets

CLEANING SYSTEM FOR A HORIZONTAL TYPE TUBE ASSEMBLY

BACKGROUND OF THE INVENTION

1. Field of the Invention

The present invention relates to a cleaning system for outer surfaces of tubes, which is available in pretreatment prior to non-destructive examination for performing thickness measurement or metallurgical structure inspection of a horizontal type tube assembly such as heat transfer tubes in a boiler.

2. Description of the Prior Art

Upon aging inspection for pipings of various plants such as boiler tubes and the like, in the preliminary stage for measurement of an outer diameter and a wall thickness which serve as a measure of a degree of wear and for discovery of flaws such as minute cracks, cleaning of the surfaces of the boiler tubes including, for instance, removal of firmly deposited ash or the like is performed, and thereafter in the inspection stage, a non-destructive examination such as, for example, liquid penetrant examination or the like is carried out.

As shown in FIG. 8, for instance, in the case where size examination for an outer diameter and a wall thickness of boiler heat transfer tubes formed in a panel shape and metallurgical structure inspection of the tubes are executed, since the interval between the adjacent tube panels is narrow, it has been often practiced that a worker would expand the panel interval by means of a jack, a chain block or the like (not shown) up to such extent that the works of cleaning, size examination and the like become possible in the space between the panels. Thereafter, generally the worker removes the ash firmly deposited on the outer surfaces of the boiler tubes by means of a commercially available JET-TAGANE (trade name) (jet-graver), a grinder or a hammer.

However, currently these works are carried out almost entirely by human labor, and execution of various kinds of examinations by labor-saving automation (remote-controlled operation) has been scarcely done in the prior art.

As described above, in the prior art since grinding and examination of an outer surface of a heat transfer tube was carried out by human labor, upon examination at a narrow place where a worker is not accessible, any one of the methods of expanding the interval between the panels by mechanical means as described above, cutting and taking out the panel to the outside of a boiler and then examining, and not performing examination but leaving the panel intact, was employed.

However, in the case of the former two methods, a lot of labor and expense were necessitated, and in the case of the last method, there remained the problem that a life and reliability of the various plants such as a boiler and the like would be degraded.

Especially in the recent years, it has been required to automate and systematize the cleaning step prior to examination, in which a cleaning device is accessible to a narrow interval without employing a scaffold and it removes solid ash and oxide scale deposited to the heat transfer tubes.

SUMMARY OF THE INVENTION

The present invention has been worked out in order to resolve such problems in the prior art. That is, the present invention relates to a cleaning system for outer tube surfaces of a horizontal type tube assembly, which is disposed in a gap space between tubes such as heat transfer tubes in a horizontal type boiler, and which is movable in the axial direction of the tubes and in the vertical direction; and the cleaning system comprises a cleaning main body section including a cleaning jig such as an air graver, a shot blast nozzle or the like, a screw and a motor in combination for reciprocating the cleaning jig in the axial direction of the tube, another motor for diverting the direction of the cleaning jig, and a support plate for supporting the aforementioned members; an upper traversing section including a winding drum, lifting wires and a winding motor in combination for raising and lowering the cleaning main body section to any arbitrary height, a traveling roller for moving in the axial direction of the tube, and a drive motor for driving the traveling roller; said cleaning main body section further including a sensor for detecting the tube during rising and lowering of the cleaning main body section, and an urging plate which is mounted to the cleaning main body section via an expansible and contractible cylinder.

According to the present invention, since the cleaning system for a horizontal type tube assembly is constructed in the above-described manner, the cleaning main body section can be moved in the axial direction of the tube up to the location to be cleaned of the horizontal type tube assembly by driving the traveling roller. In addition, the cleaning main body section can be positioned at the location corresponding to the tube to be cleaned by raising or lowering the cleaning main body section perpendicularly to the tubes by means of the winding drum, the lifting wires and the winding motor provided in the upper traversing section of the cleaning system.

Thereafter, the urging plate is moved by actuating the expansible and contractible cylinder, and by bringing the urging plate into pressure contact with another tube the cleaning main body section can be fixed in position.

When the cleaning main body section has been fixed at a predetermined position through the above-mentioned process, the cleaning jig is diverted in direction by means of the motor for diverting the direction to be moved to the position for performing cleaning of the tube, and further, while the cleaning jig is being moved in the axial direction of the tube by rotating the screw by means of the motor for reciprocating in the axial direction, cleaning of the outer surface of the tube is carried out.

When the cleaning of the tube in a predetermined range has been finished with the cleaning main body section fixed in position as described above, the cylinder is contracted to release the fixing of the cleaning main body section by the urging plate, then either the cleaning main body section is raised or lowered up to another tube, or the entire cleaning system is shifted in the axial direction of the tube, and thereby cleaning of another tube or another portion of the same tube can be carried out.

In this way, according to the present invention, it becomes possible to automatically carry out cleaning of outer surfaces of a horizontal type tube assembly.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 1:
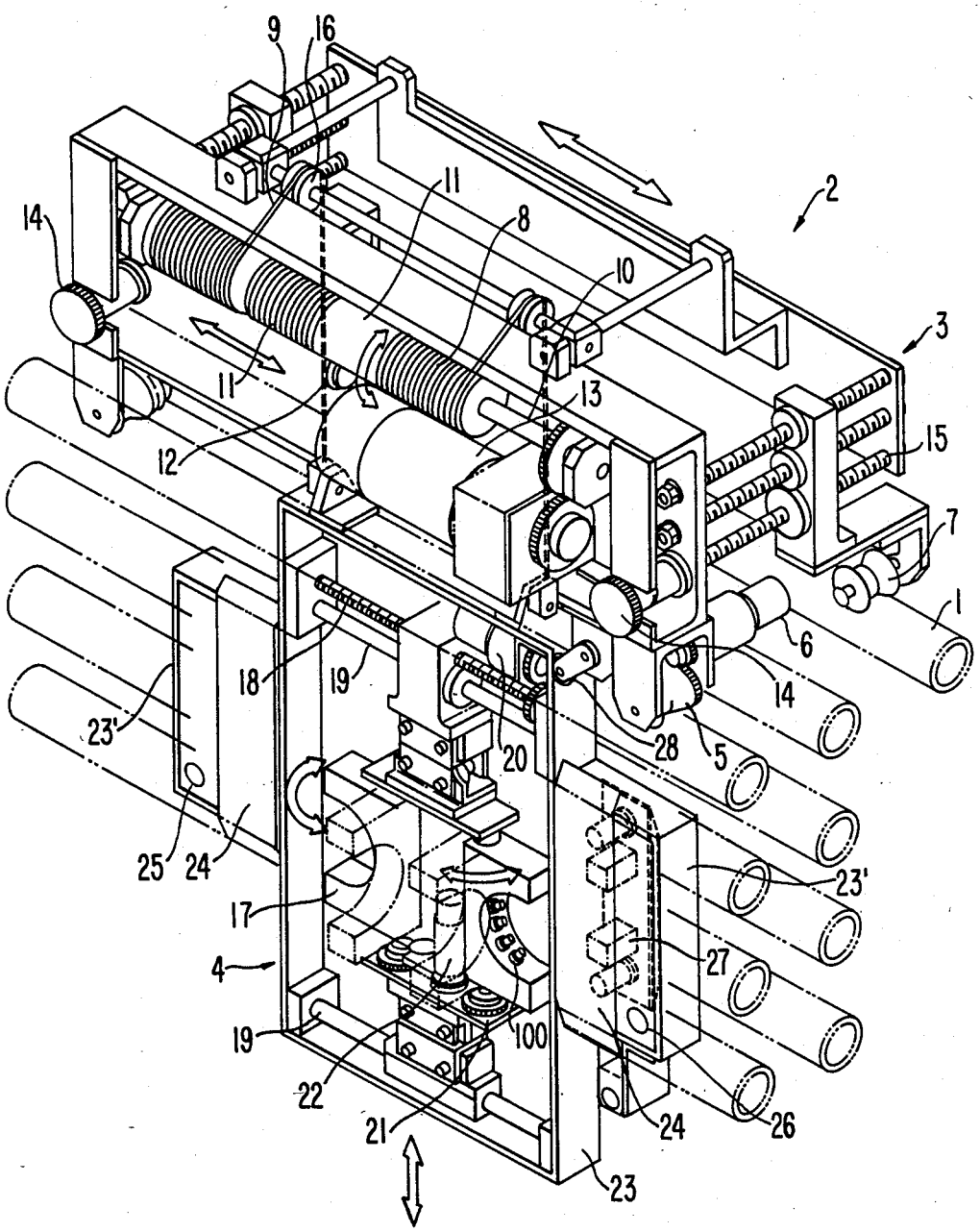
FIG. 1 is a perspective view of an entire cleaning system according to one preferred embodiment of the present invention.
Figure 2:
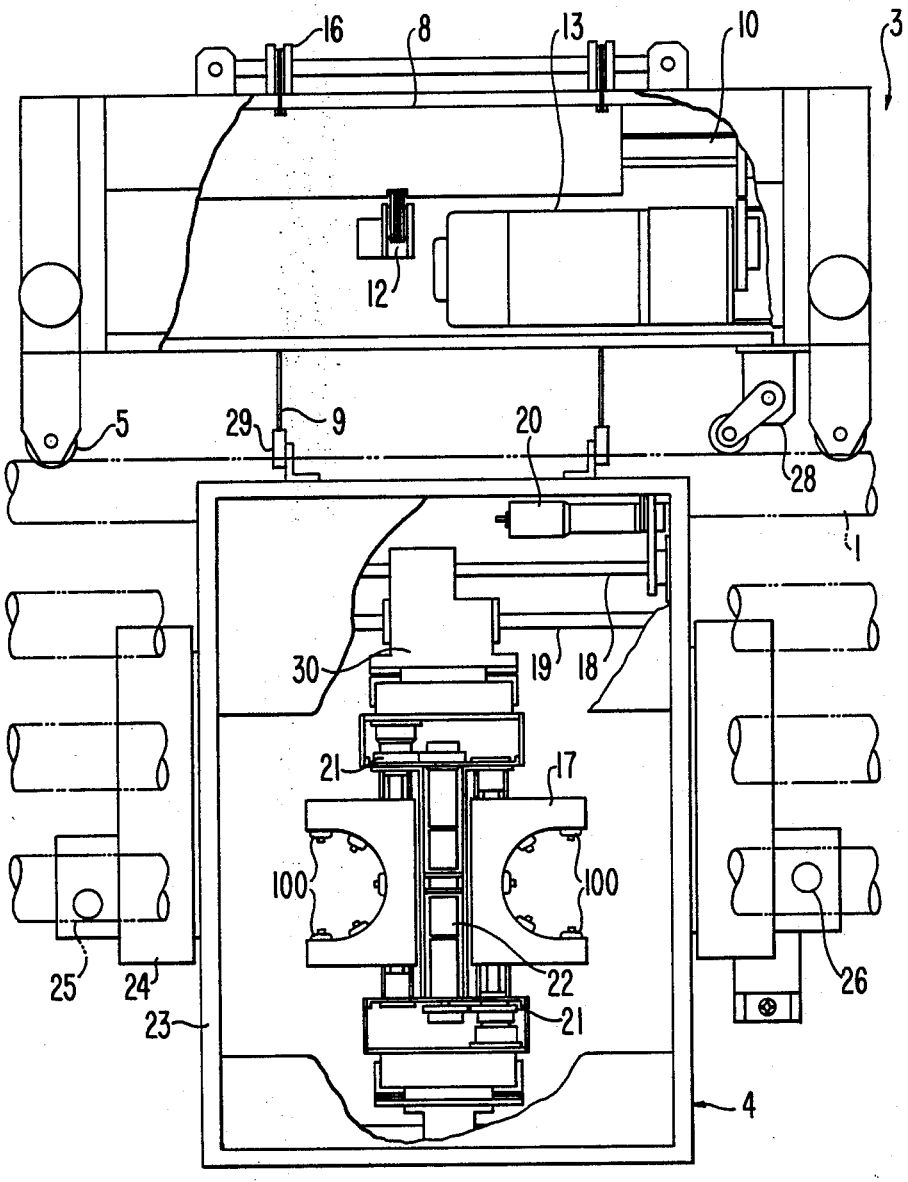
FIG. 2 is a front view of the same cleaning system.
Figure 3:
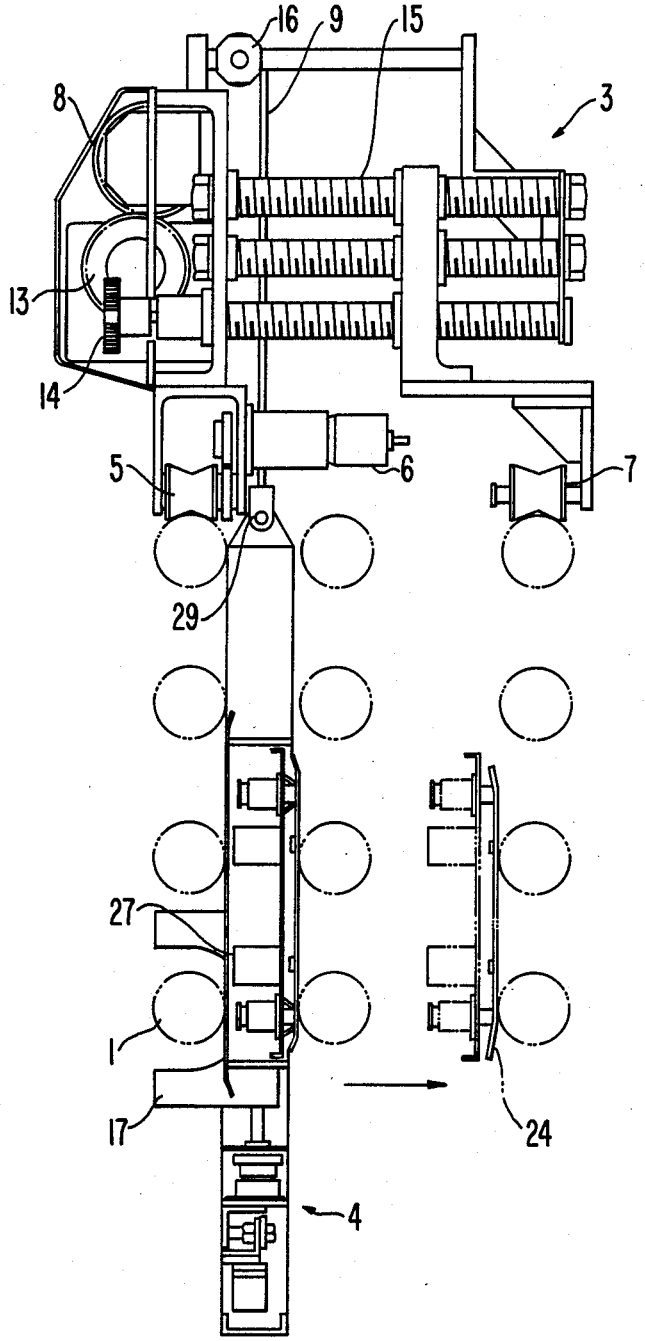
FIG. 3 is a side view of the same.

Now one preferred embodiment of the present invention will be described with reference to FIGS. 1 to 7. In these figures, FIG. 1 is a perspective view which shows whole of a cleaning system 2 which can clean outer surfaces of heat transfer tubes 1 arrayed at predetermined intervals in a horizontal type heat transfer tube assembly while moving in the axial direction of the heat transfer tubes 1 as well as in the vertical direction, FIG. 2 is a front view of the same cleaning system, and FIG. 3 is a side view of the same. In these figures, the cleaning system 2 is generally divided into an upper traversing section 3 and a cleaning main body section 4.

At first, description will be made on the upper traversing section 3. A traveling roller 5 having a constricted central portion for moving the cleaning main body section 4 as will be described later in the axial direction of the heat transfer tube 1, a drive motor 6 for driving this traveling roller 5, a guide roller 7 adapted to move on another heat transfer tube 1 for making stable movement in the axial direction of the tube possible, a winding drum 8 for raising and lowering the cleaning main body section 4, lifting wires 9 wound around the winding drum 8 and having their one ends secured to the cleaning main body section 4, a slide jig 12 disposed so as to mesh with gear grooves 11 preliminarily machined on the winding drum 8 so that the winding drum 8 may move in the axial direction along a slide shaft 10 in accordance with its own rotation to insure that the lifting wires 9 should hang always vertically, and a winding motor 13 for rotating the winding drum 8, are provided in the upper traversing section 3.

Since the interval between the heat transfer tubes 1 is different for each boiler, in order that the interval between the guide roller 7 and the traveling roller 5 can be adjusted according to the interval between the heat transfer tubes, there is provided a panel adjusting mechanism including a panel interval adjusting handle 14 and a ball screw 15 connected to the handle, so that by turning the panel interval adjusting handle 14, the guide roller 7 can be moved onto the adjacent heat transfer tube 1 along the ball screw connected to the same handle 14.

The upper traversing section 3 is associated with slide wheels 16 for adjustably sliding hanging points of the lifting wires 9 so that the cleaning main body section 4 can be raised and lowered vertically always at the most appropriate position even if the outer diameter of the heat transfer tubes 1 is varied, and the lifting wires 9 extend downwards via the slide wheels 16 and are secured to the cleaning main body section 4.

Now description will be made on the cleaning main body section 4. This cleaning main body section 4 is provided with the following members. That is, there are provided a cleaning jig support member 30 for moving one or more cleaning jigs 17 each composed of air hammers 100 or the like in the axial direction of the heat transfer tube within a predetermined range, a ball screw 18 threadedly inserted into a threaded hole in the support member 30, a slide shaft 19 slidably penetrating through a hole in the support member 30, a drive motor 20 for driving the ball screw 18, a turning gear 21 for turning the cleaning jigs 17 by 90 degrees up to the position most appropriate for cleaning the outer surface of the heat transfer tube 1, and a turning motor 22, also there is provided a support plate 23 for supporting the ball screw 18, the slide shaft 19 and the like, and on the opposite sides of the support plate 23 are provided an urging plate 24 for fixing the cleaning main body section 4 at the position of the heat transfer tube 1 to be cleaned, a tube sensor 25 for detecting existence of the heat transfer tube 1, and an approach sensor 26 for sensing a crown portion of the heat transfer tube 1. It is to be noted that the air hammers 100 forming the illustrated cleaning jig 17 are arrayed on an inner circumferential surface having a nearly semi-circular concave shape adapted for cleaning a half circumference of the heat transfer tube as shown in FIGS. 1 and 2, and two cleaning jigs 17, 17 each provided with such air hammers 100 are disposed on the opposite sides of the turning motor 22.

The above-mentioned urging plate 24 is mounted via an air cylinder 27 to panel portions 23' which are fixed to the support plate 23 and which have a tube sensor 25 and an approach sensor 26 mounted thereto, hence it can be moved by extension and contraction of the air cylinder 27, and for instance as shown in FIG. 3, this urging plate 24 is expanded by the air cylinder 27 and comes into contact with another heat transfer tube, so that it can fix the cleaning main body section 4 in position while stretching between adjacent panels.

It is to be noted that the cleaning jig 17 is not always limited to the use of air hammers 100 but other different cleaning jigs such as, for instance, shot-blast (nozzles), wire-brushes could be mounted to the cleaning main body section 4.

In the case where air hammers are employed in the cleaning jig as shown in FIGS. 1 and 2, a plurality of air hammers 100 are provided on the inner circumferential surfaces of the two, left and right cleaning jigs so as to be arrayed along the half circumference of the heat transfer tube 1, the air hammers 100 are made to vibrate strongly at a high frequency by means of compressed air, and thereby the half circumference of the outer surface of the heat transfer tube 1 would be cleaned.

The mode of operation of the air hammer used in the illustrated embodiment is shown in FIGS. 4 to 7. In the following, the structure and operation of the air hammer will be explained with reference to these figures.

In a cylinder 102 of the air hammer 100 are provided a compressed air feed port 101 adapted to be connected to a compressed air source not shown, and air exhaust holes 106 below the same feed port 101. At the top of the cylinder 102 is disposed a press lid 105, and a cylinder cap 108 is threadedly engaged with the cylinder 102 over the press lid 105. A spring 107 is interposed between the cylinder cap 108 and the press lid 105. Reference numeral 103 designates a piston inserted into the cylinder 102, and in this piston 103 are formed a bore 103" opening at the top and extending in the axial direction of the piston up to the proximity of the bottom end of the piston and air holes 104 communicating with the bottom portion of the same bore 103" and opening at the side surface. At the top of the piston 103 is provided a flange portion 103'. Arrows in FIGS. 4 to 7 indicate flows of compressed air.

Figure 4:
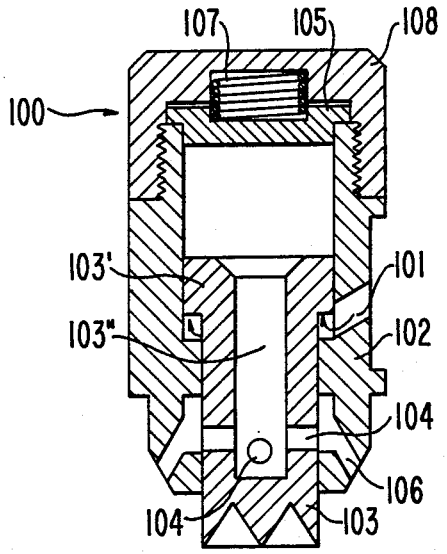
FIGS. 4 to 7 are longitudinal cross-section views showing successive steps of an operation of an air hammer used in the same cleaning system.
Figure 5:
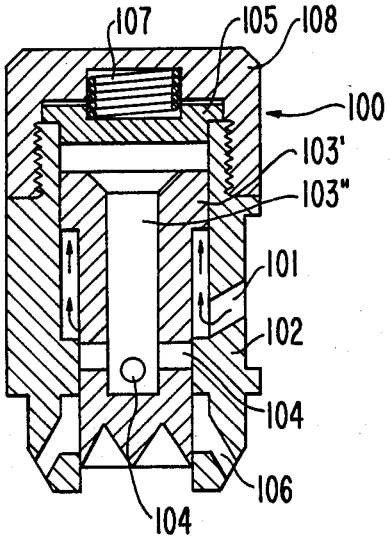
Figure 6:
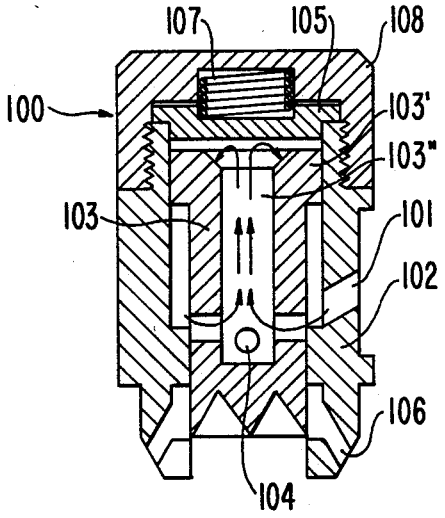
Figure 7:
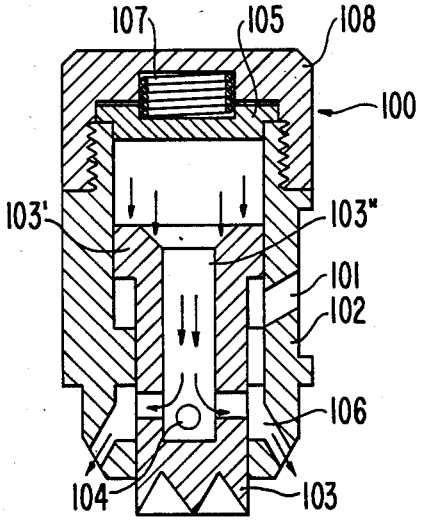
Figure 8:
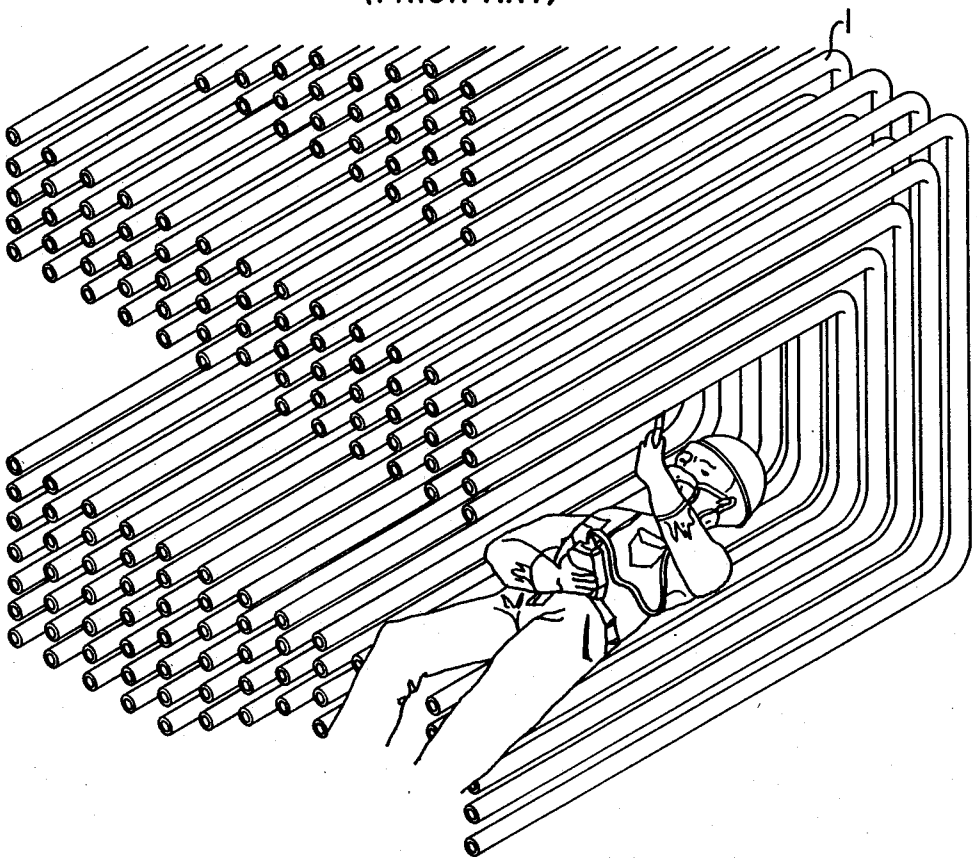
FIG. 8 (PRIOR ART)
FIG. 8 is a schematic perspective view showing the state of cleaning and examination of a horizontal type heat transfer tube assembly relying upon manual work in the prior art.

In FIG. 4, when compressed air is fed through the compressed air feed port 101 into the cylinder 102, the flange portion 103' of the piston 103 inserted into the cylinder 102 would receive the pressure of the compressed air, and so, the piston 103 would rise within the cylinder 102 (See FIG. 5). When the piston 103 has risen up to the proximity of the upper dead point, the compressed air would flow into the head space of the piston 103 (the space between the piston 103 and the press lid 105) through the air holes 104 formed in the proximity of the bottom end of the piston 103 and the bore 103" and would act upon the top end of the piston 103 (See FIG. 6), so that the piston 103 would descend abruptly. It is to be noted that when the air holes 104 of the piston 103 have been lowered up to the position of the air exhaust holes 106 (See FIG. 7), the compressed air in the head space of the piston 103 would be exhausted from the air holes 104 through the bore 103" (for the purpose of facilitating rise of the piston 103 after striking as will be described later), hence the air pressure in the head space of the piston 103 is lowered abruptly, but the piston 103 continues its descending motion due to its own inertia.

On the other hand, when the piston 103 has descended, the state shown in FIG. 4 is established, hence the piston 103 is raised by a repulsive force generated by collision with the tube and the pressure of the compressed air acting upon the flange portion of the piston 103 (See FIG. 4), and the above-described series of operations are repeated at a high frequency.

In the illustrated embodiment, a plurality of air hammers 100 having the above-described construction are assembled in the cleaning jig 17, and these air hammers 100 are disposed in such manner that the respective pistons 103 are opposed to the outer surface of the heat transfer tube 1.

It is to be noted that the compressed air fed to the above-described air cylinder 27 and the air hammers 100 is supplied from a working fluid feed source not shown. In addition, in the upper traversing section 3 is equipped an encoder 28 which is connected to a controller not shown. Furthermore, reference numeral 29 designates hooks for connecting the tip ends of the above-described lifting wires 9 with the top portion of the support plate 23 in the cleaning main body section 4.

Next, description will be made on the operation of the illustrated embodiment.

While the cleaning main body section 4 suspended at the tip ends of the lifting wires 9 is being inserted in the gap space between the heat transfer tubes 1, the traveling rollers 5 and the guide rollers 7 of the upper traversing section 3 are placed on the heat transfer tubes 1 at the highest level to set the same upper traversing section 3 on the heat transfer tubes 1 at the highest level of the horizontal type tube panel assembly, and then by rotating the traveling rollers 5 by the traveling motor 6, the cleaning system 2 is moved to a predetermined position on the heat transfer tubes 1 and stopped there. Subsequently, rotation of the winding drum 8 is commenced, and so, the cleaning main body section 4 suspended from the lifting wires 9 would descend. When a heat transfer tube 1 has been detected by the tube sensor 25, the descending speed of the cleaning main body section 4 is reduced, and then, when a crown portion of the heat transfer tube 1 has been detected by the approach sensor 26, the cleaning main body section 4 is stopped. At this moment, the air cylinder 27 for urging the main body is actuated, hence the urging plate 24 is urged against another adjacent heat transfer tube to establish a stretched condition, and thereby the cleaning main body section 4 is firmly fixed between the adjacent tube panels. Next, compressed air is supplied from a feed source not shown, and so, the pistons 103 of the plurality of air hammers 100 in the cleaning jig would commence high-speed high-frequency reciprocating motion. Under such a condition, the two, left and right cleaning jigs 17 are turned by 90 degrees by the turning motor 22, so that the plurality of air hammers 100 takes the condition of just surrounding the half circumference of the heat transfer tube 1, hence the pistons 103 of the respective air hammers 100 would repeat collision against the outer circumference of the heat transfer tube 1 at a high speed, and thereby the outer circumference of the heat transfer tube 1 can be cleaned. Under this condition, by starting the drive motor 20 and rotating the ball screw 18, the cleaning jigs 17 would be reciprocated in the axial direction of the tube along the slide shaft 19 within a predetermined range, and thus the cleaning is continued. When the above-described operation has been finished, the cleaning jigs 17 are turned by 90 degrees to return to their original conditions, then they would leave the heat transfer tube 1, and feed of the compressed air is also stopped. Thereafter, the air cylinder 27 for urging the main body is also released, the urging plate 24 is also released from the stretched condition, and the cleaning main body section 4 becomes free. Under this condition, the winding drum 8 is rotated to move the cleaning main body section 4 downwards up to another heat transfer tube 1 to be cleaned.

By automatically repeating the above-mentioned series of operations, cleaning of the respective heat transfer tubes 1 is carried out successively from an upper level of the tube panel to its lower level. When the cleaning main body section 4 has come to the lowermost level, it is confirmed by the tube sensor 25 that no heat transfer tube 1 is present at the lower level, and so, the cleaning main body section 4 would return to the uppermost level. Subsequently, after the cleaning main body section 4 has moved automatically along the heat transfer tube 1 by a preset moving distance by means of the traveling rollers 5, it commences descending for the purpose of cleaning.

By automatically repeating the aforementioned operations, the cleaning work is finished.

It is to be noted that the above-described cleaning is effected only for the half circumference of the tube.

Thereafter, the cleaning main body section 4 is disengaged from the hooks 29 at the bottom ends of the lifting wires 9 of the upper traversing section 3, and after the suspended attitude of the cleaning main body section 4 has been turned over, again it is mounted to the lifting wires 9 of the upper traversing section 3, and by performing similar operations to those described above while the cleaning main body section 4 is being moved back in the opposite axial direction to that described above, it is possible to eventually clean the entire circumference of the heat transfer tube 1.

Especially in a fired boiler making use of a lot of fuel, high-temperature oxidized scale would be produced on the heat transfer tube. Such high-temperature oxidized scale deposited onto a tube is easily torn off if impacts are applied thereto. In the illustrated embodiment, by repeating suction and exhaust of compressed air to and from an air hammer reciprocating at a high speed and by repeating high-speed impacts upon the outer circumferential surface of the heat transfer tube by means of the air-hammer piston, the high-temperature oxidized scale can be effectively torn off in a flake shape from a metal surface of the heat transfer tube. Accordingly, dispersion of dust is little, cleaning of a heat transfer tube can be effected in a short period of time, and as a result, a working environment can be improved.

As described in detail above, according to the present invention, both movement of a cleaning system in the axial direction of tubes in a horizontal type boiler heat transfer tube assembly or the like and ascent and descent of a cleaning main body section in the vertical direction relative to the tubes, are made possible, and so, cleaning of the outer surfaces of boiler heat transfer tubes in a narrow space can be carried out automatically and by remote control. In addition, when the cleaning jigs are performing cleaning, the cleaning main body section is reliably fixed by means of the urging plate, and thereby the cleaning work can be made reliable.

As described above, according to the present invention, the cleaning work in the prior art such that a narrow tube panel interval was mechanically broadened and a worker entered in the broadened space and ground the tubes by manual work by making use of a jet graver or a grinder, is not necessitated, but a cleaning work can be effected automatically and efficiently. In addition, even an outer surface of a tube at a portion where working was impossible in the prior art, can be cleaned sufficiently and exactly. Accordingly, a cleaning work for an outer surfaces of a tube is greatly saved in labor, and reduction of man-hour becomes possible.

While a principle of the present invention has been described above in connection to one preferred embodiment of the invention, it is a matter of course that many apparently widely different embodiments of the present invention could be made without departing from the spirit of the present invention.

What is claimed is:

1. A cleaning system for a horizontal type tube assembly; characterized by the provision of a cleaning main body section including a cleaning jig for an outer surface of a tube, a screw and a motor in combination for reciprocating said cleaning jig in the axial direction of said tube, another motor for diverting the direction of said cleaning jig, and a support plate for supporting the aforementioned members; and an upper traversing section including a winding drum, lifting wires and a winding motor in combination for raising and lowering said cleaning main body section to any arbitrary height, a traveling roller for moving in the axial direction of the tube, and a drive motor for driving said traveling roller; said cleaning main body section further including a sensor for detecting the tube during rising and lowering of said cleaning main body section, and an urging plate which is mounted to said cleaning main body section via an expansible and contractible cylinder.

2. A cleaning system for a horizontal type tube assembly as claimed in claim 1; characterized in that said cleaning jig is provided with air hammers for striking the outer surface of the tube.

* * * * *